United States Patent [19]

Ashforth

[11] 4,420,729

[45] Dec. 13, 1983

[54] MICROWAVE PHASE-SHIFTING APPARATUS

[75] Inventor: John V. Ashforth, Edinburgh, Scotland

[73] Assignee: Ferranti plc, Cheshire, England

[21] Appl. No.: 367,110

[22] Filed: Apr. 9, 1982

[30] Foreign Application Priority Data

Apr. 24, 1981 [GB] United Kingdom ..... 8112668

[51] Int. Cl.[3] ..... H01P 1/18; H01P 1/165

[52] U.S. Cl. ..... 333/159; 333/21 A; 333/21 R; 333/156

[58] Field of Search ..... 333/159–160, 333/21 R, 21 A, 248

[56] References Cited

U.S. PATENT DOCUMENTS 2,438,119 3/1948 Fox ..... 333/159
2,530,818 11/1950 Fox ..... 333/159
2,599,753 6/1952 Fox ..... 333/159 X
2,783,439 2/1957 Whitehorn ..... 333/21 R
3,154,754 10/1964 De Ronde ..... 333/21 R

*Primary Examiner*—Marvin L. Nussbaum
*Attorney, Agent, or Firm*—Kerkam, Stowell, Kondracki, & Clarke

[57] ABSTRACT

Microwave phase-shifting apparatus includes a section (20) of waveguide of circular cross-section having a closed end (23) and an open end. A fixed phase-shifting member (20) is located within the section to convert plane-polarized incident energy to circular polarization. A rotatable shaft (27) of dielectric material projects through the end wall of the section along the longitudinal axis, and carries a rotatable element (28). This element is of such a form and in such a position that linearly-polarized microwave energy entering the waveguide section is reflected out of the section with a reflection coefficient having a phase angle component which may be continuously adjusted over a range of 360° by rotation of the shaft, in either direction.

7 Claims, 4 Drawing Figures

MICROWAVE PHASE-SHIFTING APPARATUS

This invention relates to phase shifting apparatus operable at microwave frequencies. Continuously adjustable phase changes have been found and used for many years in the microwave energy field. A paper by A. G. Fox entitled "An Adjustable Wave-Guide Phase Changer" is published in the proceedings of the IRE, Volume 35 of December 1946 at pages 1489 to 1498, and describes one form of such a device. In general terms the device described requires three sections of circular waveguide assembled in tandem and each providing appropriate differential phase shift. The first section converts linearly polarised waves into circularly polarised waves, whilst the second changes the phase of the circularly polarised waves by rotation of the waveguide section. The third section converts the circularly polarised waves back into linearly polarised waves. The disadvantage with the device is the need to be able to rotate the second section whilst keeping the first and third sections stationary. This requires not only a suitable drive arrangement, but also bearings and rotating joints. Hence, the mechanical arrangement is essentially rather cumbersome.

It is an object of the invention to provide simple continuously adjustable microwave phase shifting apparatus of simple construction.

According to the present invention there is provided microwave phase shifting apparatus which includes a section of waveguide of circular cross-section having a closed end and an open end and of a form which will support only a single mode of propagation at a required frequency, a fixed phase-shifting member located in the waveguide section and of such dimensions and position within the section as to ensure that microwave energy directed from it towards the closed end of the section is circularly polarised, a shaft of dielectric material projecting through the closed end of the waveguide section along the longitudinal axis thereof for rotation about that axis, and a rotatable element supported by said shaft in a plane perpendicular to said axis between the polarising member and the closed end of the section, the form and position of the rotatable element being such that the element may be rotated about said axis such that linearly-polarised microwave energy entering the open end of the waveguide section is reflected out of the section with a reflection coefficient having unity magnitude and a phase angle component which may be continuously adjusted over a range of 360° in either direction.

Preferably the rotatable element is a metallic member positioned between $\frac{1}{4}$ and $\frac{1}{8}$ of a guide wavelength from the closed end of the section.

An embodiment of the invention will now be described with reference to the accompanying drawings, in which.

Figure 1:
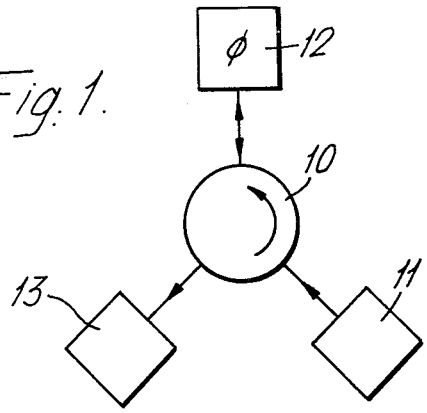
FIG. 1 is a schematic diagram illustrating an application of the invention.

Referring now to FIG. 1, this shows a conventional three-port microwave circulator 10. Microwave power from a souce 11 enters one port and leaves by the adjacent port to the phase shifter 12. The energy reflected from the phase shifter 12 passes to a load 13. The nature of the source and the load are not relevant.

Figure 2:
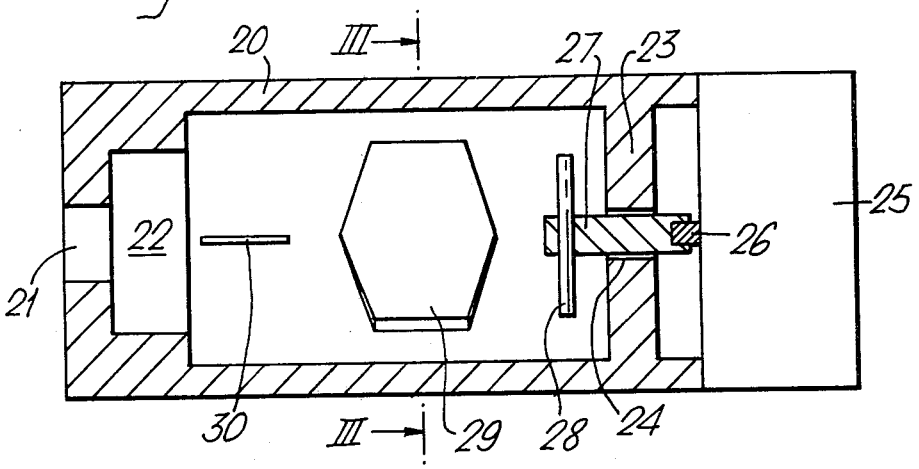
FIG. 2 is a sectional side view of a phase shifter.
Figure 3:
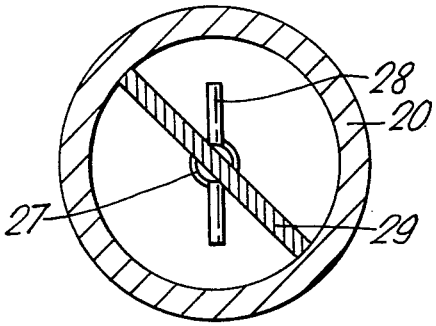
FIG. 3 is a sectional end view along the line III—III of FIG. 2.

FIGS. 2 and 3 show details of the phase shifter 12 of FIG. 1. The phase shifter has a circular body 20, and forms a section of a circular waveguide. The embodiment shown is intended for use with a rectangular waveguide system, and hence the body 20 has a rectangular port 21. The section 22 forms a quarter-wave transformer between the rectangular port and the circular body 20. The other end of the circular body is closed by an end wall 23, having a small central aperture 24. Attached to the end of the body 20 is a motor 25, having a rotatable spindle 26. A shaft 27 of dielectric material is attached to the motor spindle 26 and projects through the aperture 24 in wall 23 into the circular part of the body 20. The shaft 27 carries the rotatable element 28 which is in the form of a metallic rod.

Also located in the circular part of the body is a thin sheet 29 of dielectric material, such as alumina, positioned diametrically across the body at 45° to the vertical as shown in FIG. 3, and forming the fixed phase-shifting member. The sheet 29 is generally rectangular in shape but is somewhat pointed along the longitudinal axis of the section. Located between the entry port 21 and the dielectric sheet 29 is a card of resistive material 30, which is positioned horizontally across the waveguide section.

The dimensions of the rod 28 and its distance from the walls 23 are dependent upon the frequency of operation and upon the required bandwidth. By way of example only, for an X-band system operating at 11 GHz, maximum bandwidth (of about 1 GHz) may be obtained by using a metal rod 1.6 mm (1/16 inches) in diameter and 10.6 mm (0.42 inches) in length. The rod is arranged to be supported 0.16 of a guide wavelength from the end wall 23. In more general terms, the distance of the rod 28 from the end wall 23 shold be between $\frac{1}{8}$th of a guide wavelength.

In operation, it is assumed that the energy in the rectangular waveguide feeding the phase shifter is vertically polarised. The resistor card 30 absorbs any horizontally-polarised energy. The dielectric sheet 29 operates to convert the linearly polarised energy into circularly polarised energy. This is reflected from the end wall 23 with a reflection coefficient whose phase angle changes with changes in the angular position of the rod 28, and at twice the rate. After reflection, the energy is converted back into vertically polarised energy by the dielectric sheet 29, the phase-shift being retained. Resistor card 30 again absorbs any horizontally polarised energy, and the vertically polarised energy leaves the phase shifter through the port 21.

The combination of the rotating rod 28 and the end wall 23 servos to rotate the plane of polarisation of an incident linearly-polarised wave, and this action will take place if adjustments are made to the length of the rod and its distance from the end wall such that the reflection coefficients to incident linear polarisations both in line with the rod and orthogonal to it have phase angles which differ by 180°.

The motor 25 may be an ac or dc motor, or a stepper motor, and may include a reduction gear if required. Alternatively, the shaft may be rotated manually, or in any other way.

Figure 4:
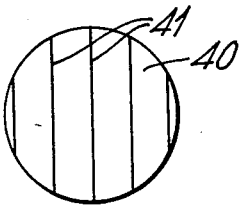
FIG. 4 shows a view of an alternative form of phase shifting element.

The rod 28 need not be of a metallic material, though its effect will be somewhat different if a dielectric material is used. Alternatively, the rod may be replaced by a disc 40 of dielectric material carrying a pattern of metallic lines 31 on one or both sides, as shown in FIG. 4.

The orientation of the dielectric sheet 29 and resistor card 30 depend upon the polarisation of the incident energy. The dielectric sheet may be replaced by inductive rods or capacitive posts. This technique is described in the Fox paper referred to above, and elsewhere in the literature. Resistor card 30 should be perpendicular to the plane of polarisation.

The phase shifter may be used with a circular section waveguide system, in which case the port 21 is of the same dimensions as the body 20, and the matching section 22 is omitted.

What we claim is:

1. Microwave phase shifting apparatus which includes a section of waveguide of circular cross-section having a closed end and an open end and of a form which will support only a single mode of propagation at a required frequency, a fixed phase-shifting polarising member located in the waveguide section and of such dimensions and position within the section as to ensure that microwave energy directed from it towards the closed end of the section is circularly polarised, a shaft of dielectric material projecting through the closed end of the waveguide section along the longitudinal axis thereof for rotation about that axis, and a rotatable element supported by said shaft in a plane perpendicular to said axis between the polarising member and the closed end of the section, the form and position of the rotatable element being such that the element may be rotated about said axis such that linearly-polarised microwave energy entering the open end of the waveguide section is reflected out of the section with a reflection coefficient having unity magnitude and a phase angle component which may be continuously adjusted over a range of 360° in either direction.

2. Apparatus as claimed in claim 1 in which the fixed phase-shifting member comprises a sheet of a dielectric material arranged at 45° to the plane of polarisation of incident microwave energy.

3. Apparatus as claimed in either of claims 1 or 2 in which the rotatable element comprises a metal rod located between one-quarter and one-eighth of a guide wavelength from the closed end of the waveguide section.

4. Apparatus as claimed in either of claims 1 or 2 in which the rotatable element comprises a plane member of dielectric material carrying on at least one surface a pattern of electrically-conducting lines.

5. Apparatus as claimed in claim 1 in which the shaft is rotatable by an electric motor.

6. Apparatus as claimed in claim 1 in which the waveguide section includes a port of rectangular cross-section and a quarter-wave transformer arranged to match the port to the body of the section.

7. Apparatus as claimed in claim 1 which includes a member of resistive material arranged perpendicular to the plane of polarisation of incident radiation.

* * * * *